US005095673A

United States Patent [19]

Ward

[11] Patent Number: 5,095,673

[45] Date of Patent: Mar. 17, 1992

[54] SYSTEM AND METHOD OF INSTALLING ROOF INSULATION

[75] Inventor: Lonnie R. Ward, Flower Mound, Tex.

[73] Assignee: Spectrum Contracting, Inc., Lewisville, Tex.

[21] Appl. No.: 521,602

[22] Filed: May 10, 1990

Related U.S. Application Data

[60] Division of Ser. No. 295,109, Jan. 9, 1989, Pat. No. 4,930,285, which is a continuation-in-part of Ser. No. 119,665, Nov. 12, 1987, abandoned.

[51] Int. Cl.[5] ..... E04B 1/74

[52] U.S. Cl. ..... 52/404; 52/410

[58] Field of Search ..... 52/406, 407, 404, 405, 52/408, 410

[56] References Cited

U.S. PATENT DOCUMENTS

| | | | |
|---|---|---|---|
| 2,893,068 | 7/1959 | Johnson | 52/404 |
| 3,378,975 | 4/1968 | Hill . | |
| 3,859,770 | 1/1975 | Chambers | 52/484 |
| 4,233,791 | 11/1980 | Kuhl | 52/309.1 |
| 4,288,951 | 9/1981 | Carlson | 52/404 |
| 4,333,292 | 6/1982 | Musgrave | 52/404 |
| 4,391,075 | 7/1983 | Musgrave | 52/404 |
| 4,449,343 | 5/1984 | Henningsen | 52/404 |
| 4,528,790 | 7/1985 | Lo | 52/407 |
| 4,545,166 | 10/1985 | Kielmeyer | 52/484 |
| 4,735,026 | 4/1988 | Forsythe | 52/404 |
| 4,856,247 | 8/1989 | Georgino | 52/404 |

*Primary Examiner*—John E. Murtagh
*Attorney, Agent, or Firm*—Daniel Rubin

[57] ABSTRACT

A system and method for installing roof insulation in commercial and/or industrial buildings in which a pattern of depending vertically oriented spindle fasteners are secured in and about the underside of the roofing and its associated support structure. Blanket and/or a radiant barrier type membrane insulation placed in position along the underside of the roof extending between and past the fasteners is adapted to be supported by longitudinally extending tandem end-to-end support bars secured to the fasteners by self-locking washers.

11 Claims, 6 Drawing Sheets

SYSTEM AND METHOD OF INSTALLING ROOF INSULATION

This application is a division, of application Ser. No. 07/295,109, filed Jan. 9, 1989, which is now U.S. Pat. No. 4,930,285 is a continuation-in-part of application Ser. No. 07/119,665 filed Nov. 12, 1987 now abandoned.

TECHNICAL FIELD

The technical field to which the invention pertains comprises the field of installed roof insulation in commercial and industrial buildings having exposed roof joists or purlins.

BACKGROUND OF THE INVENTION

The roof support structure of a commercial or industrial type building is typically constructed of parallel, spaced apart joists or purlins over which are supported the various component elements comprising the roof. Fabrication and constructions of such roofs vary widely and are exemplified by the disclosures of numerous U.S. patents. Several decades ago, the only essential purpose of a roof on most buildings was to protect and enclose the interior spacing against direct exposure to the weather elements. With the advent of temperature controlled space, particularly air conditioning as now known, and energy conservation associated with increased costs of heating fuel, the use of thermal insulation associated with the roof structure has become increasingly important. Not only does the use of thermal insulation provide a greater comfort factor within the conditioned space, but it also serves to reduce fuel consumption along with capital cost and operating cost of the conditioning equipment.

Insofar as various roof insulation systems have been disclosed in the patent literature, they generally differ from each other in the specific features of construction, method of application, useful longevity, finished appearance, ultimate degree of effectiveness for the intended purpose and/or cost of fabrication. It is known, for example, to support thermal insulation from the underside of the purlins as disclosed for example in U.S. Pat. No. 4,069,636. Such systems were specifically intended for a retrofit situation and frequently encounter obstructions such as light fixtures and sprinkler systems which interfere with installation tending to increase the unit cost over what could otherwise be achieved. Where the under joist type installations have utilized prefabricated components they are frequently dependent on critical dimensional relationships in order to effect ultimate assembly and support of the installed insulation. Since joist or purlin spans or spacings are subject to dimensional variations, dependence on a fixed dimension interlock cannot only create installation havoc but also can incur considerably difficulty as the purlins tend to roll through temperature induced expansion and contraction.

By and large the economics of roof insulation, particularly in a retrofit situation for industrial buildings, favor placement of the insulation material whether of a radiant barrier type, blanket type or a combination thereof between purlins near and below the roof deck. Such retrofit environments may even include prior insulation that is to be supplemented for enhancing the thermal barrier thereat whereby reduced heat gain in summer and reduced heat loss in winter can be achieved. Most important in connection with these add-to installations is that they are frequently contracted for on competitive bid basis. To compete effectively therefor, it is essential that labor costs for installation be minimized to the maximum extent possible while maintaining the quality of workmanship and materials intended to be provided. The difficulties and complexities of such installations should be readily apparent yet despite recognition of the foregoing problems, a ready solution therefore has not heretofore been known.

SUMMARY OF THE INVENTION

The invention relates to a system and method of installing roof insulation. More specifically, the invention hereof relates to a novel roof insulation system and method of installing roof insulation particularly suited for retrofit situations that represents the height of labor simplicity and cost effectiveness as compared to the systems and methods presently utilized.

The foregoing is achieved in accordance herewith by supporting at least layer of thermal insulation either in blanket form, radiant barrier membrane form or a combination thereof on longitudinally elongated channel sections spaced apart in aligned rows and arranged in tandem end-to-end. The channel sections are interfitted at their connecting ends for extending transversely beneath the roof purlins or beneath or through the joists. Each of the channel sections include elongated slots in the vicinity of its ends for overlapping at the interfit whereby longitudinal adjustment and temperature induced displacement of the interfit can be effected as will be understood. For supporting the channel sections, which in turn support the insulation, the overlapping slots of tandem sections are adapted to receive a metal spindle-like fastener element in one of various forms secured downwardly depending at a plurality of selected locations in a predetermined alignment. The spindle fastener elements can typically comprise a roofing nail, a capacitor discharge weld pin, a perforated base stick clip attached with self-drilling fasteners, or an element supporting spring clip, etc., that are secured from the roof or components of the roof support structure.

With the spindle fastener elements secured in place, the insulation is unrolled and fed over, under, around or through and into the approximate desired locations before the channel sections via their slots are placed interfit and overlapping onto the fasteners in their end-to-end tandem relation. With the channel sections in place on the spindles of the fastener elements, a self-locking washer is inserted over the distal end of the spindle for securing the channels in place thereby completing the installation thereat. By virtue of the foregoing simplicity, the system and method of installing roof insulation in accordance herewith lends itself well to placing insulation above and in the midst of obstructions as will be described and can conveniently be installed from virtually any type of high lift equipment utilizing a minimum of labor.

It is therefore an important aspect of the invention to provide a novel roof insulation system and method of installing insulation along the underside of roof decks.

It is a further important aspect of the invention to effect the foregoing aspect in a highly economical manner as to render the system and method hereof cost competitive in a cost conscious market by which roof insulation is supplied retrofit to existing commercial and industrial facilities.

Those skilled in the art will therefore recognize the above mentioned features and advantages of the present invention as well as additional superior aspects thereof upon reading the detailed description which follows in conjunction with the drawings.

BRIEF DESCRIPTION OF THE PREFERRED EMBODIMENTS

Figure 1:
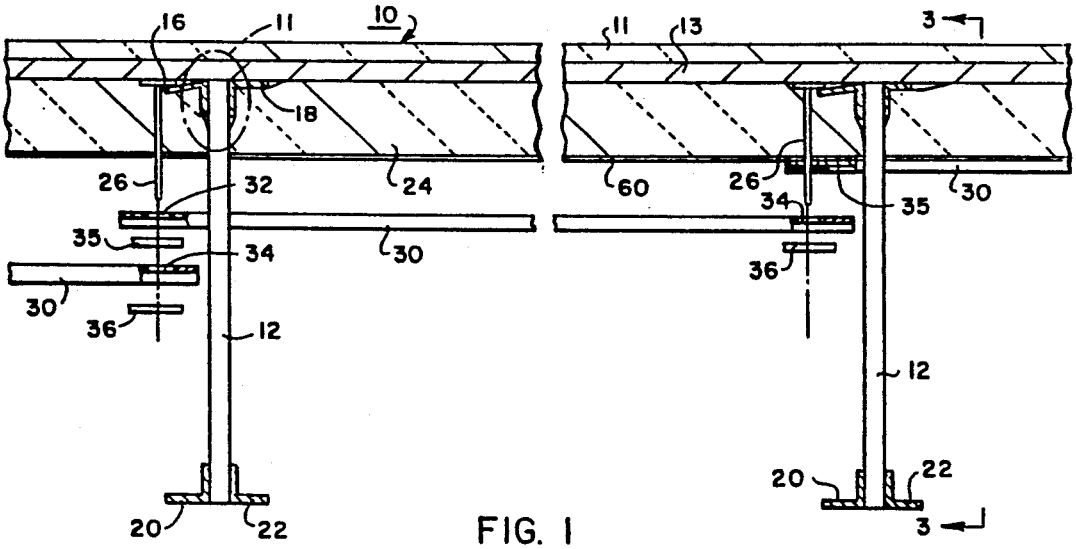
FIG. 1 is a sectional elevation of a roof support structure utilizing bar joists to exemplify a first environmental embodiment in which the invention hereof can be utilized for applying blanket insulation.

In the description that follows, like parts are marked throughout the specification and drawings with the same reference numerals, respectively. The drawing figures are not necessary to scale and certain features of the invention may be shown exaggerated in scale or in somewhat schematic form in the interest of clarity and conciseness.

Referring now to FIGS. 1, 1A, 2, 3, 10, 11 and 13, there is disclosed a first environmental embodiment of built-up roofing 10 with which the method of the invention hereof is to be utilized and for purposes of disclosure, it will be assumed the roof structure to be described is pre-existing. Consistent therewith, the roof is assumed to be comprised of a well-known construction of built-up roofing 10 including rigid insulation 11 and metal deck 13 being supported by spaced apart bar joists 12 and intermediate rafters 14. Each of the bar joists include longitudinal support top chord angle sections 16 and 18 along the upper edge for direct support of the roof 10 and longitudinal lower chord angle sections 20 and 22 along the underedge as shown for affording structural rigidity thereto.

Figure 1A:
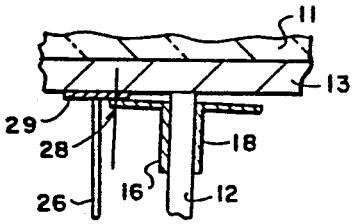
FIG. 1A is a fragmentary enlargement of the fastener support for the embodiment of FIG. 1.
Figure 16:
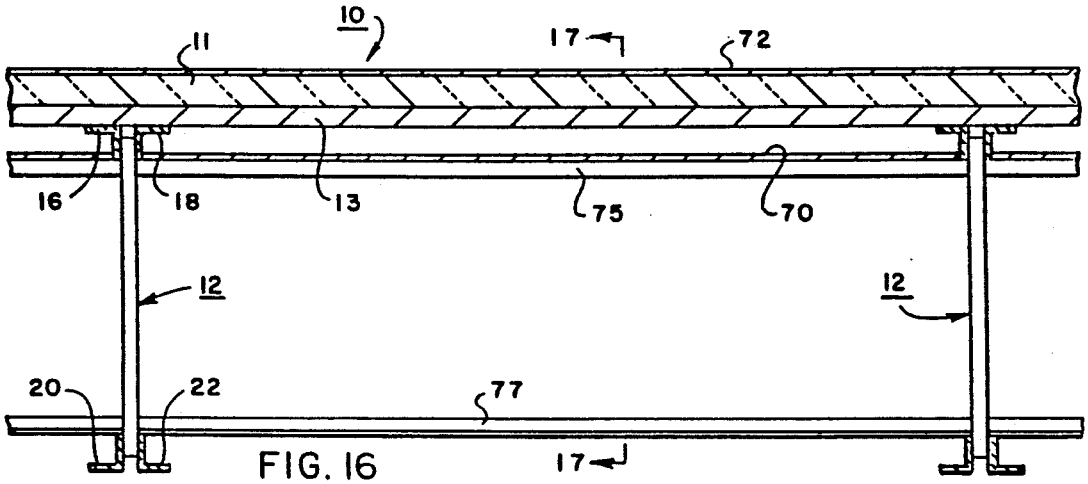
FIG. 16 is a fragmentary sectional elevation of a roof support structure similar to FIG. 1 utilizing bar joists to exemplify a fourth environmental embodiment in which the invention hereof can be utilized for installing radiant barrier membrane insulation.
Figure 17:
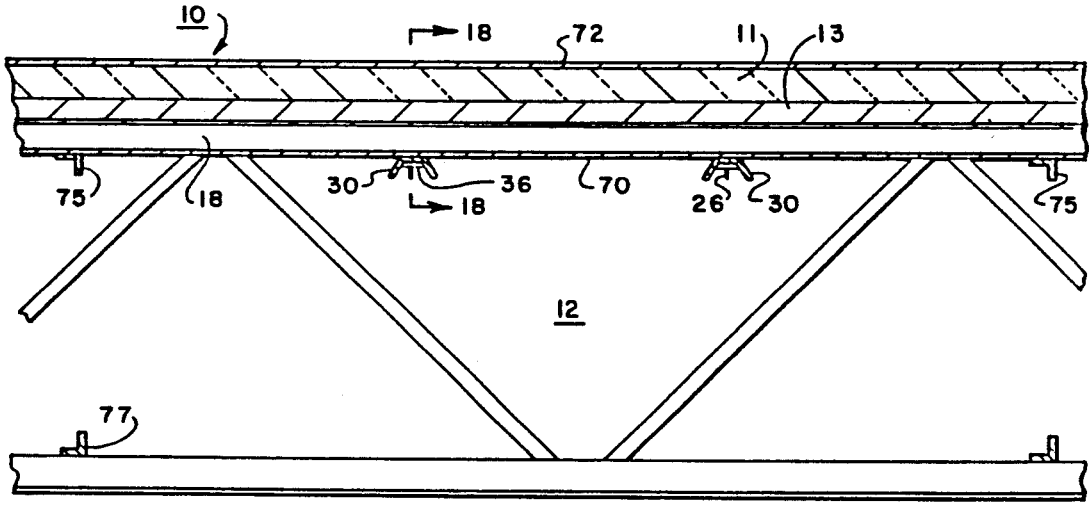
FIG. 17 is a sectional elevation as seen substantially from the position 17—17 of FIG. 16.
Figures 20A, 20B:
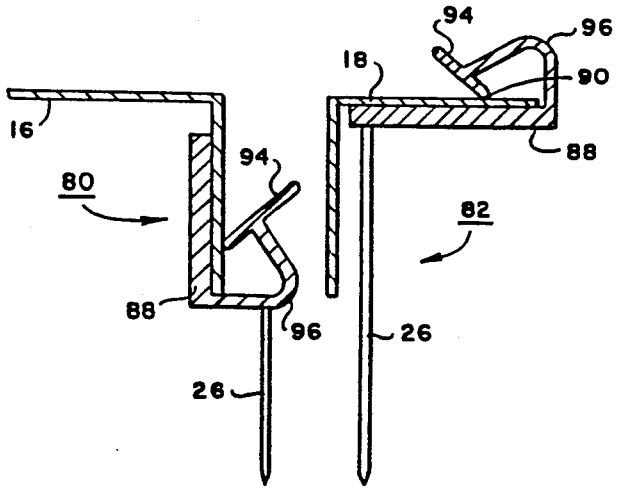
FIGS. 20(A) and 20(B) are alternate constructions of a spring attachable fastener element.

For installing a layer of blanket insulation 24 underlying metal deck 13 as a retrofit for the foregoing, there is provided a plurality of perforated-base elongated spindle fastener elements 26 each secured downwardly depending at predetermined longitudinal spacings between metal deck 13 and angle 16 (FIG. 1A). Optionally, fastener elements illustrated in FIG. 16 or spring clips illustrated in FIGS. 20(A) or 20(B) could be utilized. Securing the fasteners thereat is effected by means of self-drilling screws 28 extending through spindle base 29 into deck 13. When the spindle fastener elements 26 are in position vertically oriented downwardly depending as shown, the blanket insulation 24 is placed in a manner to be described against the underside of metal deck 11 generally through the open accesses of joists 12. The insulation is then supported thereat by means of elongated rigid straps, bars or preferably channel sections 30 secured interfit in an end-to-end tandem relation on spindles 26.

Figure 2:
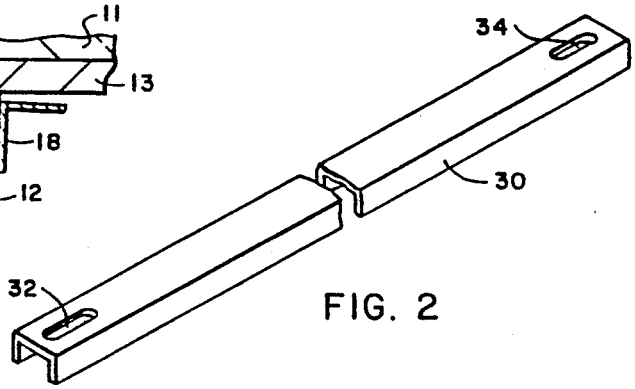
FIG. 2 is an isometric view of the insulation channel section support.
Figure 3:
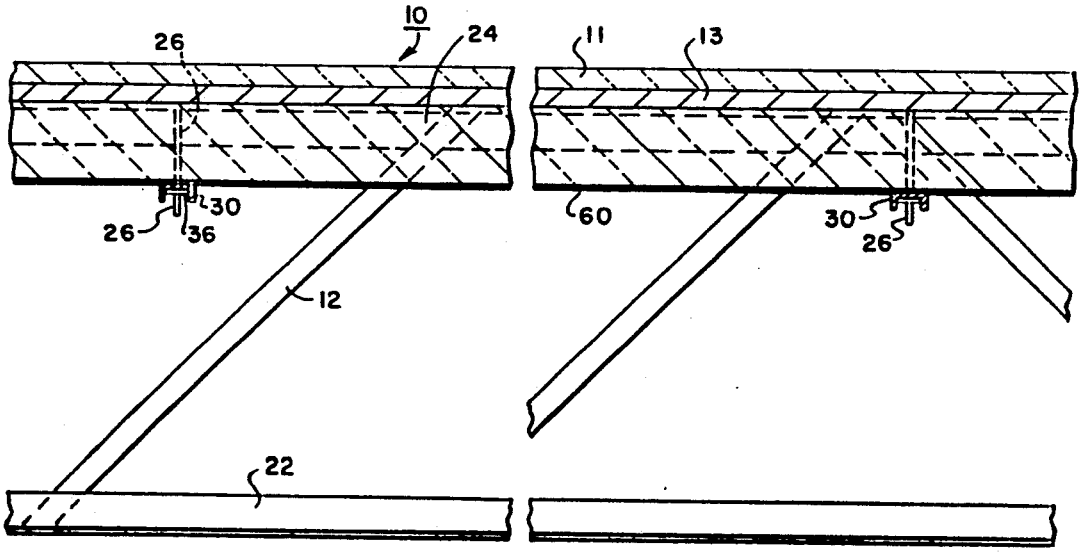
FIG. 3 is a sectional view as seen substantially from the position 3—3 of FIG. 1.
Figure 4:
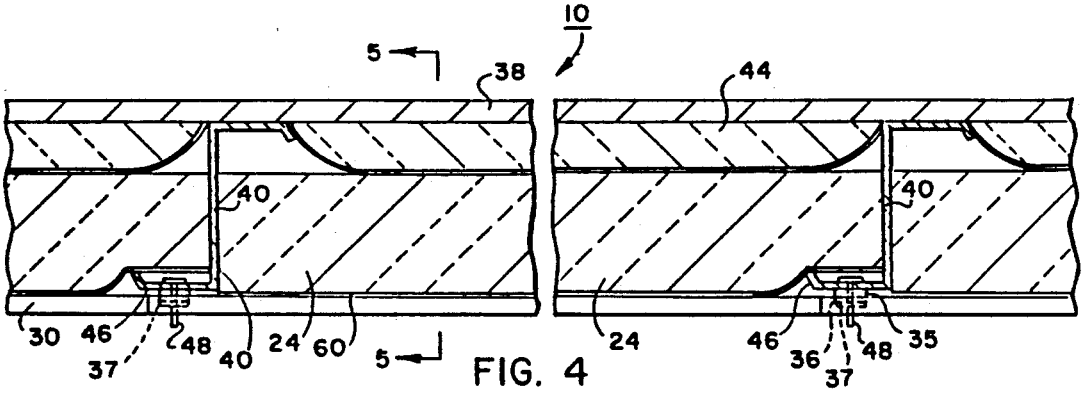
FIG. 4 is a sectional elevation of a roof support structure utilizing purlins to exemplify a second environmental embodiment in which the invention hereof can be utilized for applying blanket insulation.
Figure 5:
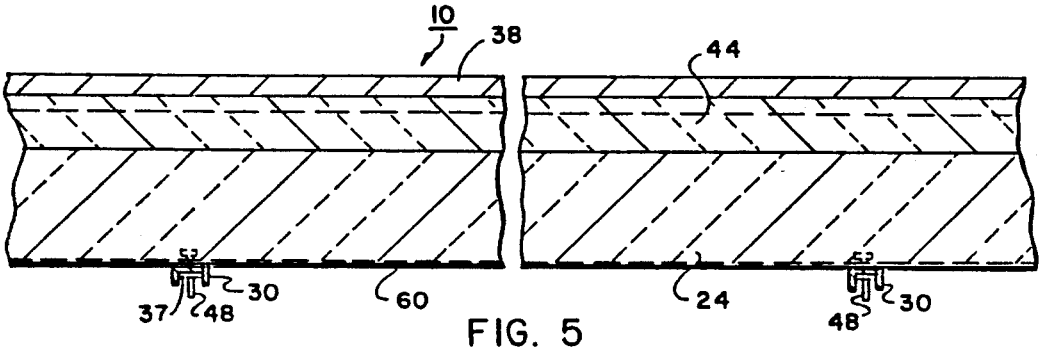
FIG. 5 is a sectional view as seen substantially from the position 5—5 of FIG. 4.

Each of the channel sections 30, as best seen in FIG. 2, and which as noted could be of other cross section, are comprised of folded 26 gauge sheet metal about one inch wide. Included near the ends are elongated slotted apertures 32 and 34 extending through the top surface and through which the distal end of spindles 26 can be received. The opposite ends are likewise configured for a male and female type overlapping interfit at their respective slots for effecting their end-to-end tandem relation as shown in FIG. 1.

With the channel sections 30 longitudinally aligned in their interfit relation with the slots 32 and 34 of the tandem sections 30 generally overlapping they ran be placed so as to receive spindle 26, followed by application of a self-locking washer 36 thereon. Washer 36 is applied onto the spindle ends of spindle 26 and forced upwardly thereon until the channels reach their intended underlying height relation for positioning insulation 24. For purposes hereof the length of channel sections 30 are approximately two inches longer than the span spacing between joists 12 with the slots 32 and 34 sized to accommodate dimensional variations an typically exist in buildings of that type. A self-locking washer 35 may be utilized to aid in the assembly of the channel sections as each section is placed in position over spindle 26.

With reference now to FIGS. 2, 4, 5, 7, 12 and 14, the second environmental embodiment hereof will be described as a retrofit for a building of all metal construction including a metal roof deck 38 supported on spaced apart parallel purlins 40 and rafter 42. It is again assumed for purposes hereof that the building to be described is pre-existing and includes prior insulation 44 secured along the undersurface of roof deck 38. For this application one or more of the various spindles fastener types hereof may be utilized. Preferably, the bottom flange 46 of each purlin is drilled at predetermined spaced apart locations along the length of the purlin to receive a 1½ inch roofing nail 48. Nail 48 is arranged downwardly depending and functions similar to spindle fastener element 26 for extending through the overlapping apertures 32 and 34 of the tandem channels 30. Likewise, nail 48 is adapted to receive self-locking washers 35 and 36 which in this instance are of ⅞ inch diameter.

Figure 6:
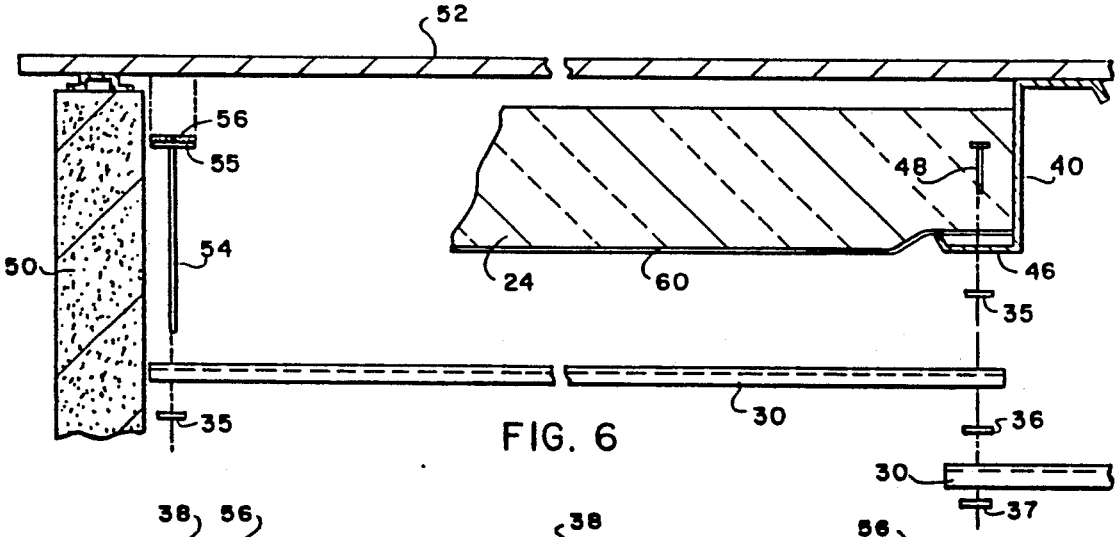
FIG. 6 is a sectional elevation of a roof support structure utilizing a combination of masonry and purlins to exemplify a third environmental embodiment in which the invention hereof can be utilized for applying blanket insulation.
Figure 7:
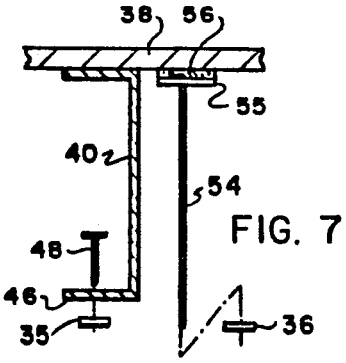
FIGS. 7, 8 and 9 are spindle fastener element alternatives for the various roof structures of the different embodiments.

With reference to FIGS. 2 and 6, the third environmental embodiment of pre-existing building construction is comprised of corrugated (metal) decking 52 supported by a combination of masonry wall 50 and parallel spaced apart purlins 40 As in the previous embodiment, the channel sections 30 are utilized for supporting blanket insulation 24 by means of nails 48 extending through drilled purlin flange 46. Self locking washers 35, 36 and 37 secure the channels in place. Adjacent to masonry wall 50, the fastener spindle element is designated 54 and includes a head 55 to which adhesive 56 has been applied for direct mounting to the underside of roofing 52. For purposes of disclosure, roofing 52 is considered to he corrugated metal while spindle 54 in this instance is of approximately 8 inch length so as to accommodate horizontal alignment of the channel section 30 from its connection at the underside of purlin 40.

Figure 10:
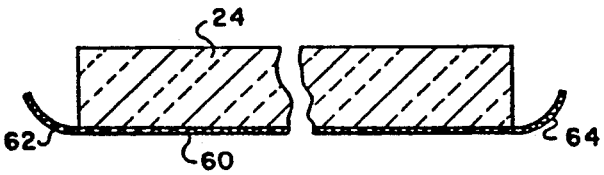
FIGS. 10 is an exemplary transverse section for a type of faced blanket type insulation as utilized herein.
Figure 11:
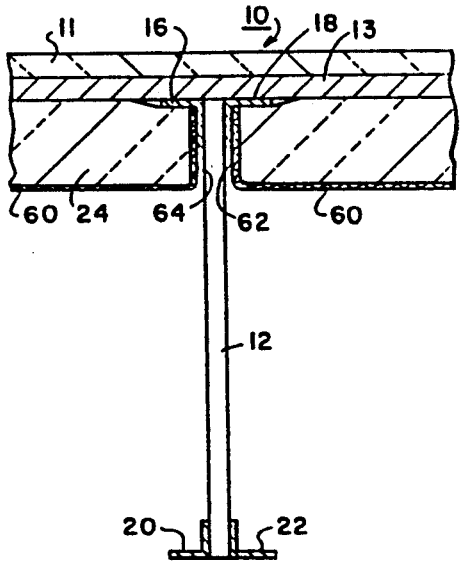
FIG. 11 is a fragmentary sectional view of the encircled portion 11 FIG. 1 for installation between parallel channel supports.
Figure 12:
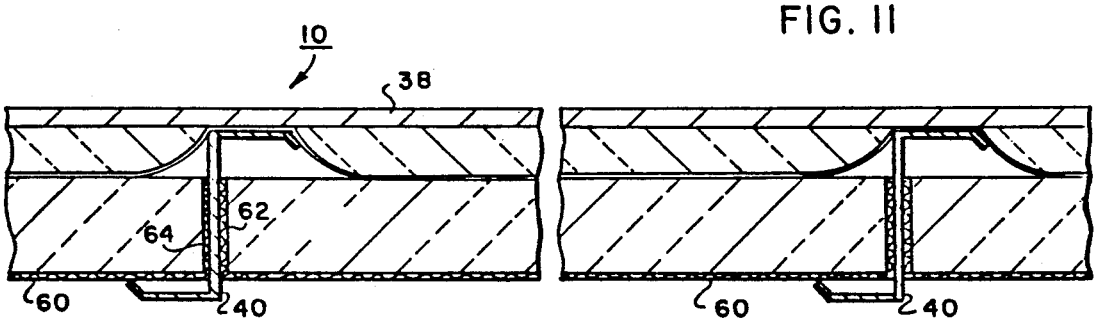
FIG. 12 is a sectional view similar to FIG. 4 for installation between parallel channel supports.

Referring to FIGS. 10–12, blanket insulation 24 may be faced or unfaced as is well known and is selected for appearance, vapor seal and/or thermal performance sought to be achieved. In a typical installation, insulation 24 is of R-10 or R-19 value rating and may for example be of 0.6 lb. density fiberglass blanket. Where faced, the insulation is preferably prelaminated with a reinforced facing 60 that typically is commercially available to correspond with 48 inch, 60 inch and 72 inch width blankets. As illustrated in FIG. 10, the vapor barrier facing 60 of insulation 24 terminates laterally along either edge in the form of longitudinal flaps 62 and 64. The flaps are normally tucked in during installation for the various embodiments in a manner illustrated in FIGS. 11, 12, and 13 so as to ensure against visibility or dusting of the fiberglass blanket.

Figure 8:
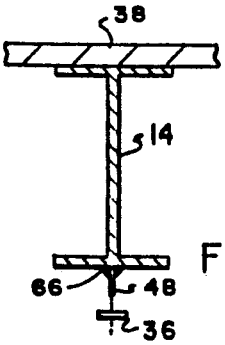
Figure 9:
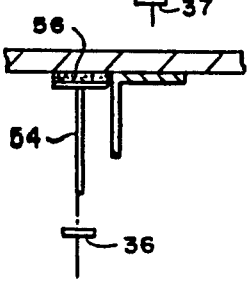

The fastener spindle elements 26, 48 and 54 as previously described can comprise one of a plurality of commercially available nails or pins alone or in combination providing a basis by which they can be secured onto the various available support surfaces and suitable for cooperating with self-locking washers 35, 36 and 37 to mount channel sections 30 thereon. Already described fastener element 26 has been illustrated as having a base secured to the underside of metal deck 13 by means of a self-drilling fastener 28. Also, fastener nail 48 has been described as extending through a drilled aperture in the flange 46 of purlin 40 while fastener 54 has been described as secured to the underside of metal roofing 52 by use of adhesive 56 applied on the fastener head 55. Spindle 48 can likewise be utilized in the manner of FIG. 8 as a capacitor discharge pin tack welded at 66 for securing the fastener to the underside of purlin 14 or elsewhere where desired. Common to the various fastener forms are the elongated spindle element extending from a base or head secured at a selected surface site and adapted to cooperate with suitable self-locking washers for secured retention of end-to-end channel sections 30.

Figure 15:
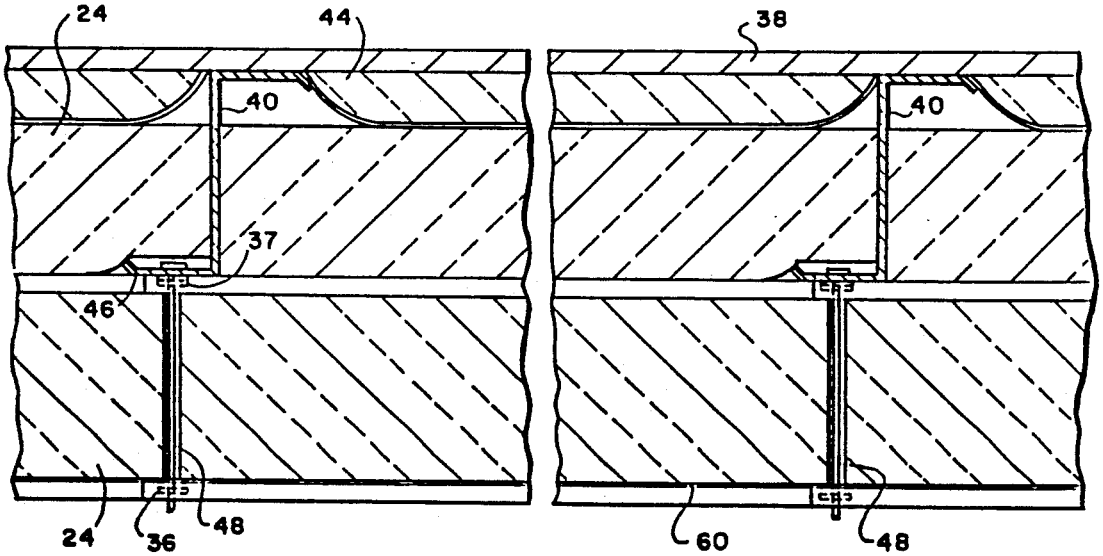
FIG. 15 is an optional embodiment for installing multi-layer blanket insulation.

For the embodiment of FIG. 15, there is illustrated an optional construction for applying insulation in the form of multi-layer insulation blankets 24 superposed one on the other. For this embodiment, a first six inch unfaced fiberglass layer 24 is positioned up against the existing insulation 44 while a second six inch blanket of faced insulation 24 is supported underlying and subtending thereto. Fastener 48 for these purposes is of increased length extending first through the flange 46 for supporting channel sections 30 in parallel relation beneath the upper and lower layers of insulation and to receive self-locking washers 35, 36 and 37 at each of the channel levels.

In the embodiment of FIGS. 16–19, the method and system of the invention is specifically adapted for radiant barrier type insulation designated 70 for effectively impeding radiant heat transfer. Such insulation is particularly suited for the southern regions of the United States and has received considerable technical support from the Florida Solar Energy Center (FSEC) in Cape Canaveral, Fla.

The radiant barrier insulation 70 as commercially available is comprised of a foil layer or double sided foil layers of stitch reinforced aluminum available in spooled form which when emplaced is exposed to an airspace such as an attic area. It is also available as single sided foil with a backing such as kraft paper or propypropylene or as a foil faced on conductive type blanket insulation. Typical installations would include mounting or applying membrane sheets to the underside of a solar exposed roof, the underside of the roof chord, overlying ceiling insulation, etc. It has been established that a layer of radiant barrier type insulation eliminates about ninety-five percent of radiant heat transfer across an exposed air space and which can be further enhanced by utilizing multiple layers. Bearing in mind that solar produced radiant heat is a most significant load factor on any air conditioning system, the economics of reduced equipment sizing and/or operating costs by using radiant barrier insulation can be enormous.

For purposes of disclosure it will again be assumed that built up roofing 10 illustrated in FIGS. 16–19 likewise is preexisting and is comprised of metal decking 13 supporting rigid insulation 11 on which an overlying roof membrane 72 is contained. Roof support is provided by joists 12 along with interior rafters or joist girders 74 supported on a column 76. The joists include a top chord comprised of angle sections 16 and 18 and a lower chord comprised of angle sections 20 and 22. Also included is top chord bridging 75 and lower chord bridging 77.

Figure 18:
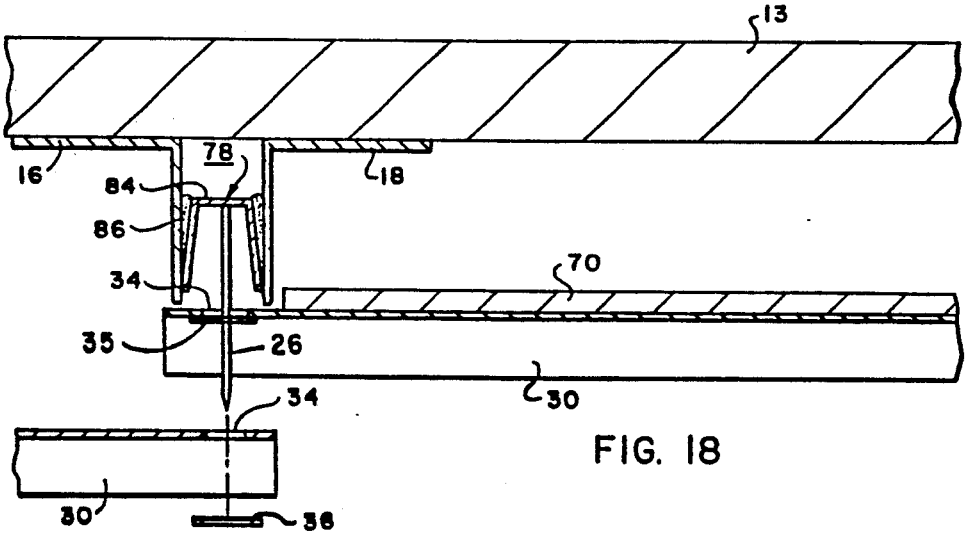
FIG. 18 is a fragmentary enlargement of the fastener support for the embodiment of FIG. 16.
Figure 19:
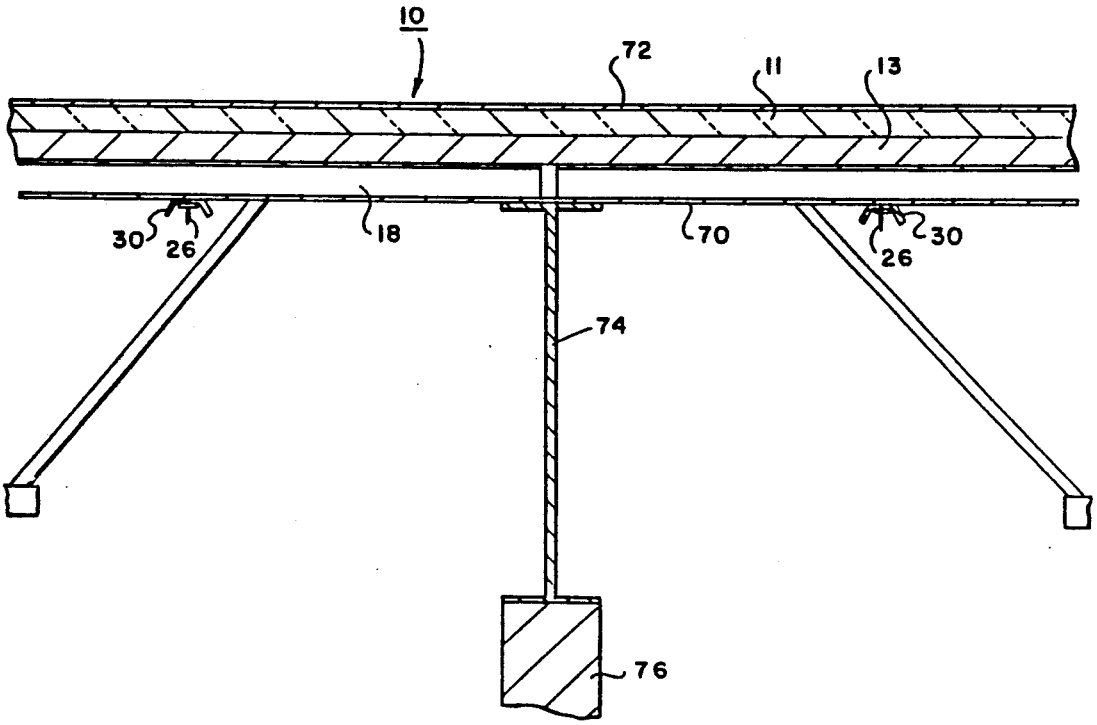
FIG. 19 is a fragmentary sectional elevation from the plane of FIG. 16 in the rafter or girder areas of the roof.

Installation of insulation membrane 70 is initiated by first placing an appropriate fastener element on or within the upper chord of the joist. Preferred for this embodiment is either a fastener element 78 as illustrated in FIG. 18 or one of the spring clamp fastener elements 80 or 82 illustrated in FIG. 20. Comprising fastener element 78 is a bent generally U-shaped head 84 sized for a force fit within the upper chord intermediate the joist bracing and to which it is secured as by adhesive 86. Downwardly depending from head 84 is a centrally located vertical spindle 26 as described supra.

Comprising the clamp fasteners 80 and 82 of FIG. 20 is a fairly rigid body base 88 secured by pre-bent intervening leaf spring 96 to offset fingers 94. Between the engaging portion of fingers 94 and body 88 there is normally defined a closure or narrow clearance opening 90. Downwardly depending from either the leaf spring or body as shown is a spindle 26 as above. To emplace the clamp, the clearance 90 is first increased by spreading fingers 94 from base 88 and forcing the clamp onto the chord angle. Releasing the spread enables the base 88 and fingers 94 to impose a firm grip onto the joist angle chord thereat.

Once the fastener elements are in place, an end of a selected form of radiant barrier membrane 70 of about 1/64 inch thickness and weighing about 15–26 lbs. per thousand square feet is first suspended on a spool adjacent to the deck. Thereafter, a controlled length of the membrane is extended by unwinding from the spool and is supported in place via channel sections 30 in parallel relation to receive self-locking washers 35 and 36. Being of thin section and lightweight, the membrane 70 is easily passed over the chord bridging 75. It can also be fed over the rafters 74 enabling building width (or length) rolls rather than bay length rolls to be reasonably handled by one person.

To avoid unsightly sag of barrier membrane 70, it is preferred to maintain transverse spacing between adjacent channels 30 to less than about forty-two inches. It will be appreciated that installation in the foregoing manner requires only three "passes", including one to install the spindles, one to spread or thread the membrane and one to install the channel supports. For this application, rolled perforated strapping (not shown) could be substituted for channel sections 30.

For effecting installation of the system hereof, the specific fasteners to be employed are first selected on the basis of suitability for the predicted insulation type and thickness and the building construction with which the fasteners are to be utilized. Because of the vast array of shapes and sizes of the various roof decks and framing members, e combination of spindle types may be necessary as described supra.

The first step for installation in accordance herewith is to lay out the spindle locations. On the purlins this is commonly completed with a marker and an appropriate jig for maintaining spacing and alignment. When the purlin flanges are to be drilled it is commonly done by a workman with a jig in one hand and a cordless drill in the other hand such that the worker simply drills holes in the bottom flange through which the roofing nails of selected length can conveniently be dropped. The fastener nails 48 are then secured in place with self-locking washers 35. In buildings having rigid insulation above a metal deck, perforated base spindles are attached at selected spacings via self-drilling fasteners 28 utilizing cordless drill/screw gun. In other circumstances, pin welding or heat resistant adhesive can be utilized as a desirable option for attaching the fastener spindles. In older buildings, thickness of the purlins frequently render pin welding preferable to drilling. For use when installing radiant barrier membrane 70, spindle forms 78, 80 or 82 can be utilized.

Figure 13:
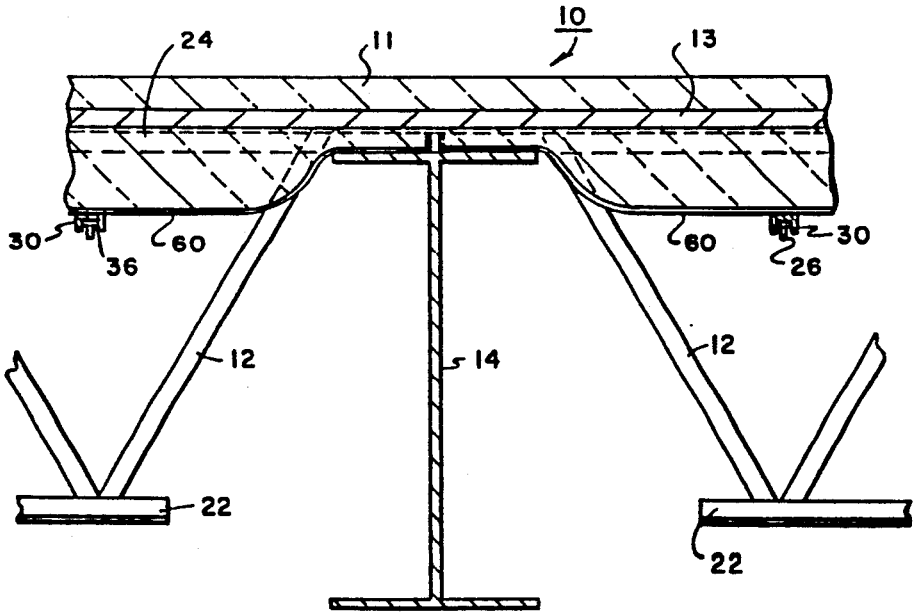
FIG. 13 is a sectional elevation for the embodiment of FIG. 1 in the rafter support area.
Figure 14:
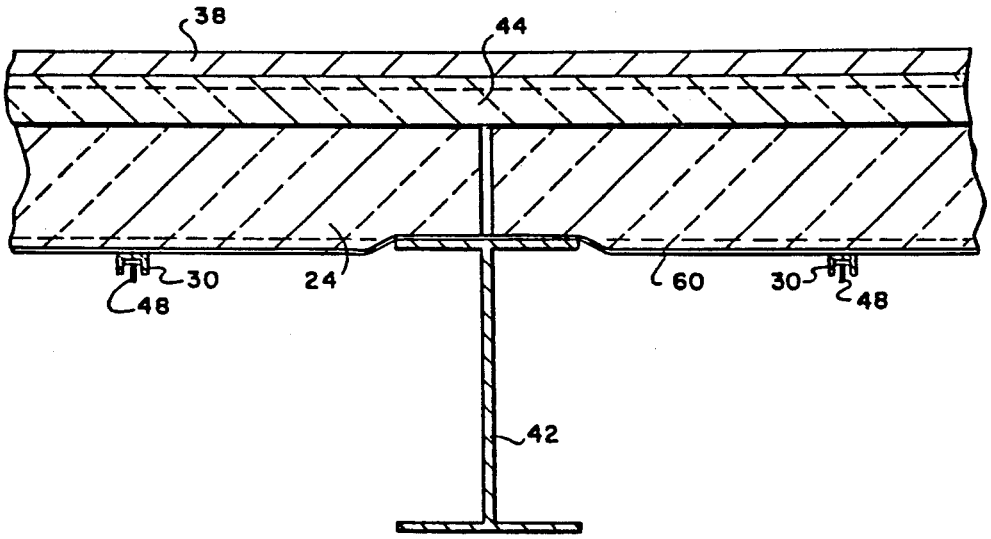
FIG. 14 is a sectional elevation for the embodiment of FIG. 4 in the rafter support area.

Once the fasteners have been pre-placed downward depending vertically oriented in position, the faced (or unfaced as appropriate) blanket insulation or radiant barrier membrane is unrolled and fed over, under, around, or through and into the approximate desired locations. In the course of being applied it is sequentially supported with channel sections 30 and the self-locking washers placed onto the previously installed spindles in the manner described. For single layer blanket installations, the side tabs 62 and 64 are tucked up next to the webs of the purlins or top chords of the joists and the roll ends butted over the rafters (FIG. 13). The foregoing is repeated until the entire area of installation is completed. Where obstructions are encountered they can be conveniently dealt with. For example, where piping is encountered in the insulation space, the insulation can be split to receive the pipe and then retaped. Where pipe is secured along the underface of a purlin, a longer spindle is utilized lowering the transverse channel section 30 to below the pipe. If necessary, the channel sections can be cut and suspended by fasteners at either side of the pipe. Other alternatives will likely occur to those skilled in the art.

By the foregoing description there is described a novel method for installing roof insulation in a highly economical and expedient manner eliminating many of the previous inefficiencies and cost factors associated with such installations in the prior art. The system lends itself readily to either blanket or membrane type insulation placed above and in the midst of obstructions on or attached to the fraxing members and can be installed utilizing virtually any type of high lift equipment. The method and system hereof are particularly suited for retrofit installations to existing buildings in which one man can conveniently install the spindles and to other men can follow with the insulation and channels By separating the operations, all bays can be laid out by spindle placement and two virtually unskilled workers without the use of tools can complete the installation. In a relatively unobstructed building, two workers can realistically install 3–4 blanket rolls per hour for an average exceeding 130 square feet per man hour including the time spent on the preceding spindle placement. Installation of radiant barrier membrane 70 typically can be completed at a rate exceeding 230 square feet per man hour. The virtues of the foregoing should be readily appreciated by those skilled in the art in enabling increased insulation to be added to existing structures at lower costs than heretofore. While emphasis has been placed on retrofit installation for purposes of disclosure, it should be readily apparent that the system and method hereof are likewise applicable to new construction.

Since many changes could be made in the above construction and many apparently widely different embodiments of this invention could be made without departing from the scope thereof, it is intended that all matter contained in the drawings and specification should be interpreted as illustrative and not in a limiting sense.

What is claimed is:

1. A system of under-roof insulation for a roof deck supported by underlying, spaced apart, structural steel support members comprising:

a plurality of elongated spindle-like fastener elements each having a cross head for mounting the fastener element to an existing surface in the underlying roof area defined by said steel support members and the undersurface of said roof deck;

said fastener elements when secured to an existing surface being arranged spaced apart in a predetermined alignment and depending substantially in a vertical orientation relative to the under surface of said roof deck;

at least one layer of thermal insulation of predetermined thermal rating extending past said fastener elements within said underlying roof area generally parallel to and intervening said roof support members;

relatively rigid elongated insulation support members mounted in an end-to-end tandem relation onto said fastener elements underlying said thermal insulation and extending in a direction generally transverse to the direction of said roof support members; said insulation support members including a slotted aperture located near each of their ends and said end-to-end relation of the tandem members being effected by an interfit providing an overlap of respective apertures through which to receive a depending fastener element; and interlock members comprising a self-locking washer adapted to interlock with the distal spindle end of said fastener element when slip fit thereon, and mounted on the distal ends of said fastener elements for securing said insulation support members in said underlying relation to support the insulation thereat.

2. A system of insulation in accordance with claim 1 in which said thermal insulation comprises a membrane composition effective as a radiant barrier.

3. A system of insulation in accordance with claim 1 in which said thermal insulation comprises a blanket composition.

4. The system of insulation in accordance with claim 1 in which the cross head of said fastener elements are mounted to said existing surface by a structure selected from the group consisting of adhesive, weld, spring grip, and self drilled fastener.

5. The system of insulation in accordance with claim 1 in which at least one of the overlapping apertures in each of said support members is slotted to permit relative dimensional adjustment in spanning the longitudinal spacing between fastener elements.

6. The system of insulation in accordance with claim 5 in which said insulating support members comprise narrow channel sections of sheet metal composition.

7. The system of insulation in accordance with claim 1 in which the roof deck support members include braced bar joists having a top chord defined by spaced apart angle members and the spindle of said fastener elements thereat depend from a location intervening between said angle members.

8. The system of insulation in accordance with claim 7 in which the cross heads of at least some of said fastener elements comprise a spring clamp mounted in a spring grip relation to one of said angle members and the spindle thereof depends in a substantially vertical orientation downwardly from said clamp.

9. The system of insulation in accordance with claim 7 in which the cross heads of said fastener elements at said top-chord are mounted intervening in the spacing between said angle members.

10. A system of under-roof insulation for a roof deck supported by underlying, spaced apart, structural steel support members including braced bar joists comprising:

plurality of elongated spindle-like fastener elements each having a cross head for mounting the fastener element to an existing surface in the underlying roof area defined by said steel support members and the undersurface of said roof deck;

said fastener elements when secured to an existing surface being arranged spaced apart in a predetermined alignment and depending substantially in a vertical orientation relative to the under surface of said roof deck;

at least one layer of thermal insulation of predetermined thermal rating extending past said fastener elements within said underlying roof area generally parallel to and intervening said roof support members;

relatively rigid elongated insulation support members mounted in an end-to-end tandem relation onto said fastener elements underlying said thermal insulation and extending in a direction generally transverse to the direction of said roof support members and through open areas defined by the bracing comprising said bar joists; and interlock members comprising a self-locking washer adapted to interlock with the distal spindle end of said fastener element when slip fit thereon and mounted on the distal ends of said fastener elements for securing said insulation support members in said underlying relation to support the insulation thereat.

11. The system of insulation in accordance with claim 1 in which the roof deck support members include longitudinally extending spaced apart purlins and at least some of said fastener elements have their cross heads mounted to the existing flange surfaces of said purlins.

* * * * *

UNITED STATES PATENT AND TRADEMARK OFFICE

CERTIFICATE OF CORRECTION

PATENT NO. : 5,095,673

DATED : March 17, 1992

INVENTOR(S) : Lonnie R. Ward

It is certified that error appears in the above-identified patent and that said Letters Patent is hereby corrected as shown below:

Column 4, line 48 "ran" should read -- can --; and line 56 "an" should read -- as --.

Column 5, line 25 "he" should read -- be --.

Column 7, line 35 "e" should read -- a --.

Column 8, line 19 "fraxing" should read -- framing --; and line 23, "to" should read -- two --.

Column 10, line 42, "1" should read -- 10 --.

Signed and Sealed this

Ninth Day of March, 1993

*Attest:*

STEPHEN G. KUNIN

*Attesting Officer*

*Acting Commissioner of Patents and Trademarks*